US011668062B2

(12) United States Patent
Collingwood et al.

(10) Patent No.: US 11,668,062 B2
(45) Date of Patent: Jun. 6, 2023

(54) FLOOD DEFENCE

(71) Applicant: Flood Control International Ltd, Devon (GB)

(72) Inventors: Timothy Lester Collingwood, Devon (GB); Andrew Colin Yates, Cornwall (GB); Keith Lee Stevens, Devon (GB)

(73) Assignee: Flood Control International Ltd., Devon (GB)

( * ) Notice: Subject to any disclaimer, the term of this patent is extended or adjusted under 35 U.S.C. 154(b) by 0 days.

(21) Appl. No.: 17/455,558

(22) Filed: Nov. 18, 2021

(65) Prior Publication Data

US 2022/0162821 A1 May 26, 2022

Related U.S. Application Data

(60) Provisional application No. 63/116,408, filed on Nov. 20, 2020.

(51) Int. Cl.
*E02B 3/10* (2006.01)
*E02B 3/16* (2006.01)

(52) U.S. Cl.
CPC ..... *E02B 3/102* (2013.01); *E02B 3/16* (2013.01)

(58) Field of Classification Search
CPC . E02B 3/10; E02B 3/102; E02B 3/104; E02B 3/106; E02B 3/16; Y02A 10/30; Y02A 10/11; E04H 9/14
See application file for complete search history.

(56) References Cited

U.S. PATENT DOCUMENTS 6,390,730 B1 * 5/2002 Scheibe ..... E02B 7/44 256/13
6,413,014 B1 * 7/2002 Melin ..... E02B 3/106 405/113
6,840,711 B1 * 1/2005 Martinez ..... E02B 3/106 405/15
9,458,588 B2 * 10/2016 Waters, Jr. ..... E02B 3/104
9,689,129 B2 * 6/2017 Kelly ..... E02B 7/44
(Continued)

FOREIGN PATENT DOCUMENTS

DE 10162568 A1 7/2003
DE 102004015322 A1 10/2005
(Continued)

OTHER PUBLICATIONS

Tom Simmonds; Search Report; Great Britain Application No. GB2106777.2; dated Oct. 12, 2021; UK Intellectual Property Office; South Wales.

(Continued)

*Primary Examiner* — Benjamin F Fiorello
(74) *Attorney, Agent, or Firm* — Stevens & Showalter LLP

(57) ABSTRACT

A stowable flood barrier system comprising: first and second barrier modules each comprising a frame and a barrier panel pivotable with respect to the frame between a stowed position and a deployed position, in which deployed position a base of the barrier panel is sealed against the frame and a free edge of the barrier panel extends clear of the frame to present a barrier segment between lateral edges of the barrier panel, wherein the first and second barrier modules are sealable together in the deployed position along the lateral edges of their respective barrier panels to form a linked flood barrier.

24 Claims, 6 Drawing Sheets

(56) References Cited

U.S. PATENT DOCUMENTS

| | | | | |
|---|---|---|---|---|
| 10,508,396 | B2 * | 12/2019 | Kullberg | E02B 3/106 |
| 10,619,318 | B1 * | 4/2020 | Waters, Jr. | E02B 7/50 |
| 10,697,144 | B2 * | 6/2020 | Kimura | E05D 3/06 |
| 10,895,051 | B2 * | 1/2021 | Van den Noort | E02B 3/062 |
| 10,975,538 | B2 * | 4/2021 | Adler | E04H 9/145 |
| 2003/0190193 | A1 * | 10/2003 | Waters, Jr. | E02B 7/205 405/110 |
| 2004/0096275 | A1 * | 5/2004 | Rorheim | E02B 3/102 405/114 |
| 2007/0189854 | A1 | 8/2007 | Forrest | |
| 2009/0169306 | A1 * | 7/2009 | Rijlaarsdam | E02B 3/102 405/114 |
| 2013/0094906 | A1 * | 4/2013 | Rijlaarsdam | E02B 3/106 405/115 |
| 2015/0117952 | A1 * | 4/2015 | Gujer | E02B 7/36 405/96 |
| 2016/0201281 | A1 * | 7/2016 | Roy | E02B 3/102 405/107 |
| 2017/0175352 | A1 | 6/2017 | Farhadzadeh et al. | |
| 2019/0112772 | A1 * | 4/2019 | Steinhardt | E02B 7/22 |

FOREIGN PATENT DOCUMENTS

| | | | |
|---|---|---|---|
| EP | 0802285 | A2 | 10/1997 |
| EP | 1589152 | A2 | 10/2005 |
| GB | 2457463 | A | 8/2009 |

OTHER PUBLICATIONS

Flip Up Barriers; Flood Control International; product data sheet available on Feb. 28, 2012 at https://floodcontrolinternational.com. Flip-up Flood Barrier at Mardyke Arena in Cork—Flood Control International Ltd; Feb. 28, 2012; available on YouTube at https://www.youtube.com/watch?v=ftZRcNWI7-I.

* cited by examiner

FLOOD DEFENCE

CROSS REFERENCE TO RELATED APPLICATIONS

This application claims priority to U.S. Application No. 63/116,408 filed Nov. 20, 2020 and titled "IMPROVEMENTS RELATING TO FLOOD DEFENCE". U.S. Application No. 63/116,408 is hereby fully incorporated by reference as if set forth fully herein.

TECHNICAL FIELD

This invention relates to flood defence. In particular, though not exclusively, this invention relates to a stowable flood barrier system and a method of erecting a flood barrier.

BACKGROUND

A flood is an overflow of water that submerges land that is usually dry. Floods are of significant concern in agriculture, civil engineering and public health.

Various flood defence systems are known, including flood barriers, flood gates and flood doors that act to prevent or control flood water and offer protection against damage.

Such structures must be engineered to high standards to resist reliably the significant force of flood waters over time. The requisite performance and reliability are most readily achieved with permanent flood defence systems. However, permanent flood defence systems can significantly impair access and are thus unsuitable in many locations, for example on roads or runways.

To address this issue, removable flood barriers have thus been developed. However, there is generally a trade-off between the effectiveness of such impermanent flood barriers and convenience.

One known example of a removable flood barrier is a flip-up flood barrier. This type of flood barrier comprises a barrier panel pivotable with respect to a frame between a stowed position and a deployed position. In the deployed position a base of the barrier panel is sealed against the frame and a free edge of the barrier panel extends clear of the frame to present a barrier between lateral edges of the barrier panel. In the stowed position the barrier is housed out of the way, conveniently at ground level.

Whilst flip-up flood barriers can be engineered to meet the high standards required to reliably resist flood waters, their application has been limited by their size. The barrier panels of flip-up flood barriers are finite in dimension for logistical and cost reasons and must be sealed against robust external structures at each lateral edge. Such external structures constrict access when the flood barrier is not in use.

There remains a need in the art for a flood defence system which overcomes the paradox of convenience and effectiveness.

It is an object of the invention to provide a flood defence which addresses or mitigates at least one of the above problems or another problem associated with the prior art.

SUMMARY OF THE INVENTION

From a first aspect, the invention provides a stowable flood barrier system comprising: first and second barrier modules each comprising a frame and a barrier panel pivotable with respect to the frame between a stowed position and a deployed position, in which deployed position a base of the barrier panel is sealed against the frame and a free edge of the barrier panel extends clear of the frame to present a barrier segment between lateral edges of the barrier panel, wherein the first and second barrier modules are sealable together in the deployed position along the lateral edges of their respective barrier panels to form a linked flood barrier.

Suitably, the first and second barrier modules may comprise differing sealing interfaces that are co-operable in the deployed position to seal together the first and second barrier modules. Advantageously, the first barrier module may comprise an inflatable sealing interface and the second barrier module may comprise a non-inflatable sealing interface. Optionally, the second barrier module may comprise a compressible sealing interface.

In some embodiments, each of the first and second barrier modules comprises a frame seal for sealing the base of its barrier panel against its frame; and the first barrier module comprises a lateral seal for sealing together the first and second barrier modules along the lateral edges of the respective barrier panels to form the linked flood barrier. The bases of the barrier panels of the first and second barrier modules may advantageously be offset with respect to each other in the deployed position such that the lateral seal of the first barrier module can seal against an end of the frame seal of the second barrier module. The base of the barrier panel of the first barrier module may optionally comprise rounded corners between the lateral edges of the barrier panel and a base edge of the barrier panel and the bases of the barrier panels of the first and second barrier modules may be offset with respect to each other in the deployed position such that the end of the frame seal of the second barrier module seals against the lateral seal of the first barrier module beyond a corner radius of the rounded corners.

In some embodiments, the lateral seal of the first barrier module is inflatable to seal together the first and second barrier modules along the lateral edges of the respective barrier panels to form the linked flood barrier. Optionally, the frame seal of the first barrier module may be inflatable to seal the first barrier module against the frame of the first barrier module. Conveniently, the frame seal and the lateral seal may be integral. Suitably, the base of the barrier panel of the first barrier module may comprise rounded corners between the lateral edges of the barrier panel and a base edge of the barrier panel, and the frame seal and lateral seal of the first barrier module may be constituted by an inflatable U-shaped seal running along the lateral edges, the base edge and the rounded corners of the panel.

Optionally, the frame seal of the second barrier module may be compressed against the frame when the barrier panel of the second barrier module is brought into the deployed position. Advantageously, the base of the barrier panel of the second barrier module may comprise an engagement surface for engaging the frame seal, the engagement surface being angled such that the barrier panel exerts compressive force on the frame seal substantially orthogonally to the engagement surface. Optionally, the frame may comprise a seat surface for engaging the frame seal, the seat surface being angled such that the frame exerts compressive force on the frame seal substantially orthogonally to the seat surface.

Conveniently, the frame seal of the second barrier module may be non-inflatable.

Advantageously, the frame of each barrier module may comprise one or more mounts upon which then barrier panel is pivotably mounted. The mounts of the first and second barrier modules may define co-axial or parallel pivot axes.

Advantageously, the system may comprise a plurality of the first barrier module and/or a plurality of the second barrier module, the first and second barrier modules alternating in extension of one another and being sealable together in the deployed position along the lateral edges of their respective barrier panels to form the linked flood barrier. Conveniently, the system may comprise an odd number of alternating barrier modules. Advantageously, the system may comprise first barrier modules as terminal modules.

Suitably, outer ones of the first barrier modules may flank one or more inner barrier modules, the outer barrier modules being sealable against an external structure.

Advantageously, the first and second barrier modules may be aligned such that the barrier segments offered by the first and second barrier modules in the deployed position have co-planar surfaces.

Conveniently, the system may comprise a housing pit for holding the first and second barrier modules. Optionally, the system may comprise a security grate for covering the barrier pit when the barrier panels are in the deployed position.

Advantageously, the system may be installed in the ground such that the barrier panels are flush with the ground in the stowed position.

The barrier panels of the first and second barrier module may suitably comprise a friction-increasing surface finish, optionally selected from epoxy resin, timber cladding and paving.

In some embodiments the system may comprise a drive mechanism for moving the barrier panels of the first and second barrier modules between the stowed position and the deployed position. The drive mechanism may suitably allow for independent or sequential movement of the barrier panels of the first and second barrier modules between the stowed position and the deployed position.

Optionally, the system may comprise a flood condition sensor and a controller configured to deploy the flood barrier by bringing the barrier panels of the barrier modules into the deployed position in response to a detected flood condition. Advantageously, the system may also comprise a proximity sensor to detect obstruction and wherein the controller is configured to omit or halt deployment of the flood barrier in response to a detected obstruction.

From a second aspect, the invention provides a method of erecting a flood barrier, the method comprising installing a flood barrier system according to the first aspect with the first and second barrier modules adjacent, bringing the barrier plates of the barrier modules into the deployed position and sealing the adjacent first and second barrier modules together.

Throughout the description and claims of this specification, the words "comprise" and "contain" and variations of the words, for example "comprising" and "comprises", mean "including but not limited to", and do not exclude other components, integers or steps. Moreover the singular encompasses the plural unless the context otherwise requires: in particular, where the indefinite article is used, the specification is to be understood as contemplating plurality as well as singularity, unless the context requires otherwise.

Preferred features of each aspect of the invention may be as described in connection with any of the other aspects. Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible.

BRIEF DESCRIPTION OF THE DRAWINGS

One or more embodiments of the invention will now be described, by way of example only, with reference to the accompanying drawings, in which.

DETAILED DESCRIPTION

Figure 1A:
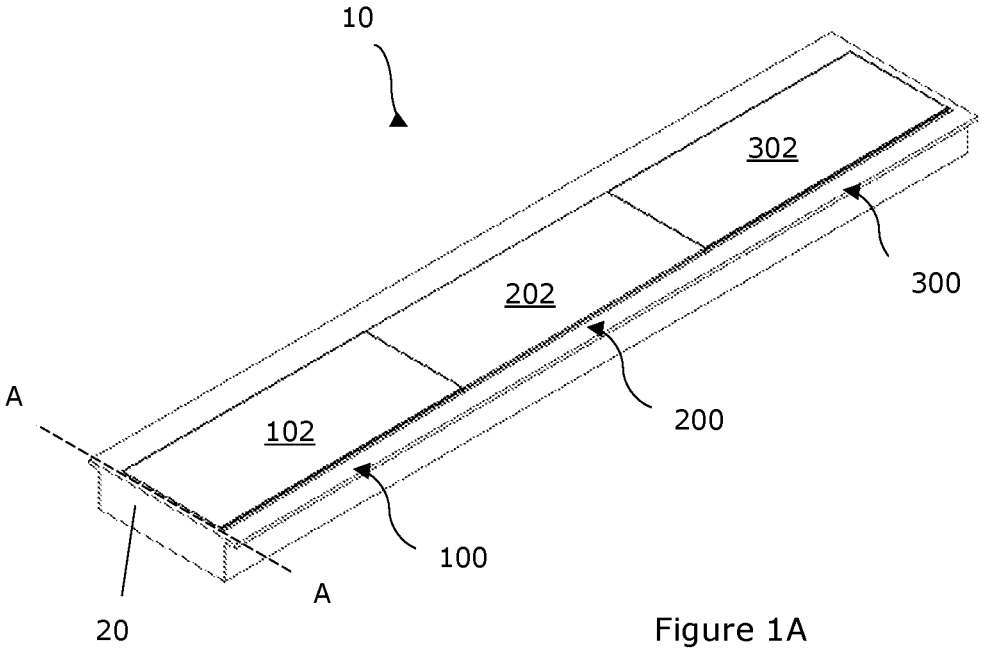
FIG. 1A is a perspective view of a flood barrier system in accordance with one embodiment of the invention in an inactive configuration.

Referring to FIG. 1A a flood barrier system 10 comprises a plurality of generally rectangular barrier modules 100, 200, 300 adjacent and aligned within a housing pit 20. Like reference numerals are used for like parts in the modules 100, 200, 300.

Three barrier modules (of two different types) are shown in the Figures for simplicity, but, as the system 10 is modular, any desired number of modules may be incorporated in the system 10. Suitably, the system 10 may have an odd number of alternating modules of different type, so that terminal modules are identical.

The flood barrier system 10 can provide a flood barrier of desired length in locations requiring a high degree of accessibility. The system 10 can be installed, for example, by embedding the housing pit 20 at ground level. Conveniently, the system 10 may be constructed of steel, although other materials can also be chosen as desired.

Figure 1B:
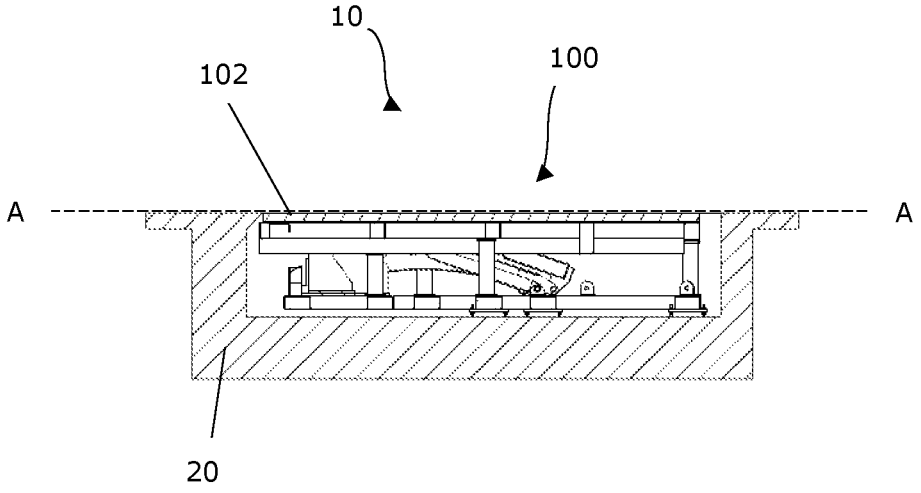
FIG. 1B is a cross-sectional view of the flood barrier system of FIG. 1A in the inactive configuration, taken at line A-A shown in FIG. 1A.

Referring still to FIG. 1A and additionally to FIG. 1B, the system 10 has an inactive configuration in which the barrier modules 100, 200, 300 are wholly contained within the housing pit 20 in a stowed position. Only a barrier panel 102, 202, 302 of each barrier module 100, 200, 300 is visible and covers the housing pit 20. The barrier panels 102, 202, 302 are co-planar and can lie flush with the ground if the housing pit 20 is suitably embedded. Thus, in the inactive configuration, the system 10 can avoid impeding access.

Figure 2A:
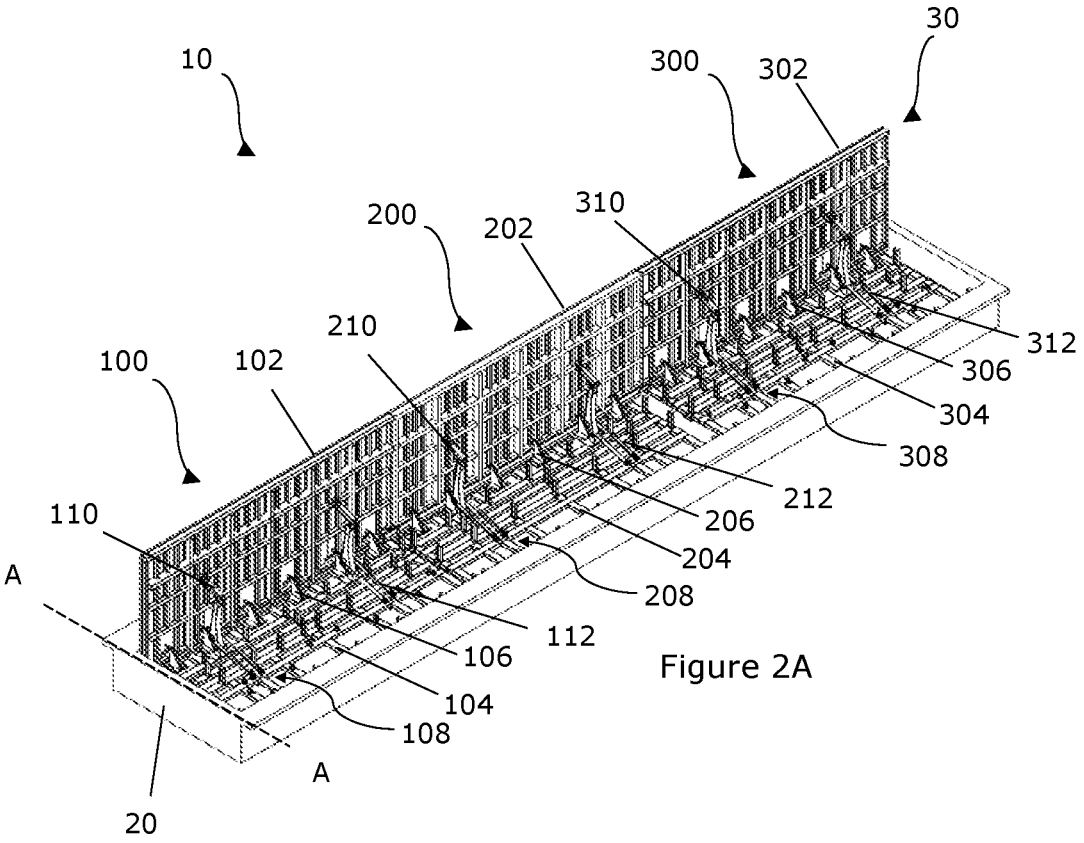
FIG. 2A is a perspective view of the flood barrier system of FIGS. 1A and 1B in an active configuration.
Figure 2B:
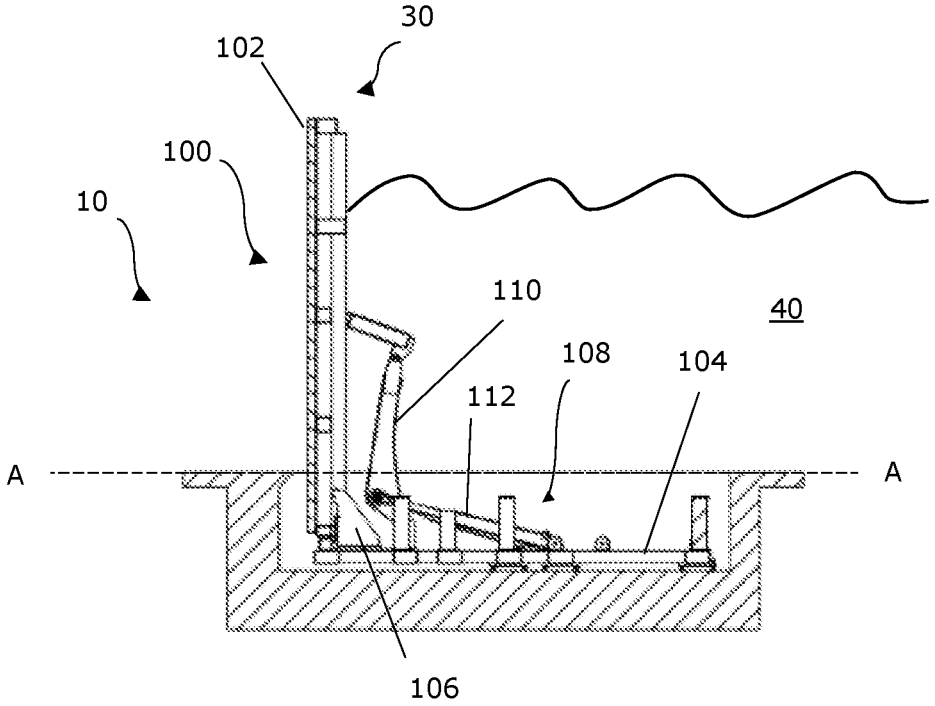
FIG. 2B is a cross-sectional view of the flood barrier system of FIGS. 1A and 1B in an active configuration, taken at line A-A shown in FIG. 2A.

Turning now to FIGS. 2A and 2B, when a flood barrier is required, the system 10 can be brought into an active configuration. In the active configuration each of the barrier panels 102, 202, 302 of the barrier modules 100, 200, 300 is brought into a deployed position. The barrier panels 102, 202, 302 are sealed together to form a linked flood barrier 30 that extends clear of the housing pit 20. Thus, in the active configuration the system 10 provides an effective barrier to flood waters 40 (which are shown only in FIG. 2B for clarity).

Once the flood waters 40 have receded the system 10 can be brought back into the inactive configuration by moving each barrier panel 102, 202, 302 of the barrier modules 100, 200, 300 back into the stowed position. The barrier panels 102, 202, 302 may suitably comprise a non-slip surface, or a surface that camouflages the barrier panels when stowed.

To facilitate movement of the barrier panels 102, 202, 302 between the stowed position and the deployed position, the barrier panels 102, 202, 302 are pivotably mounted in their barrier modules 100, 200, 300.

Figure 3:
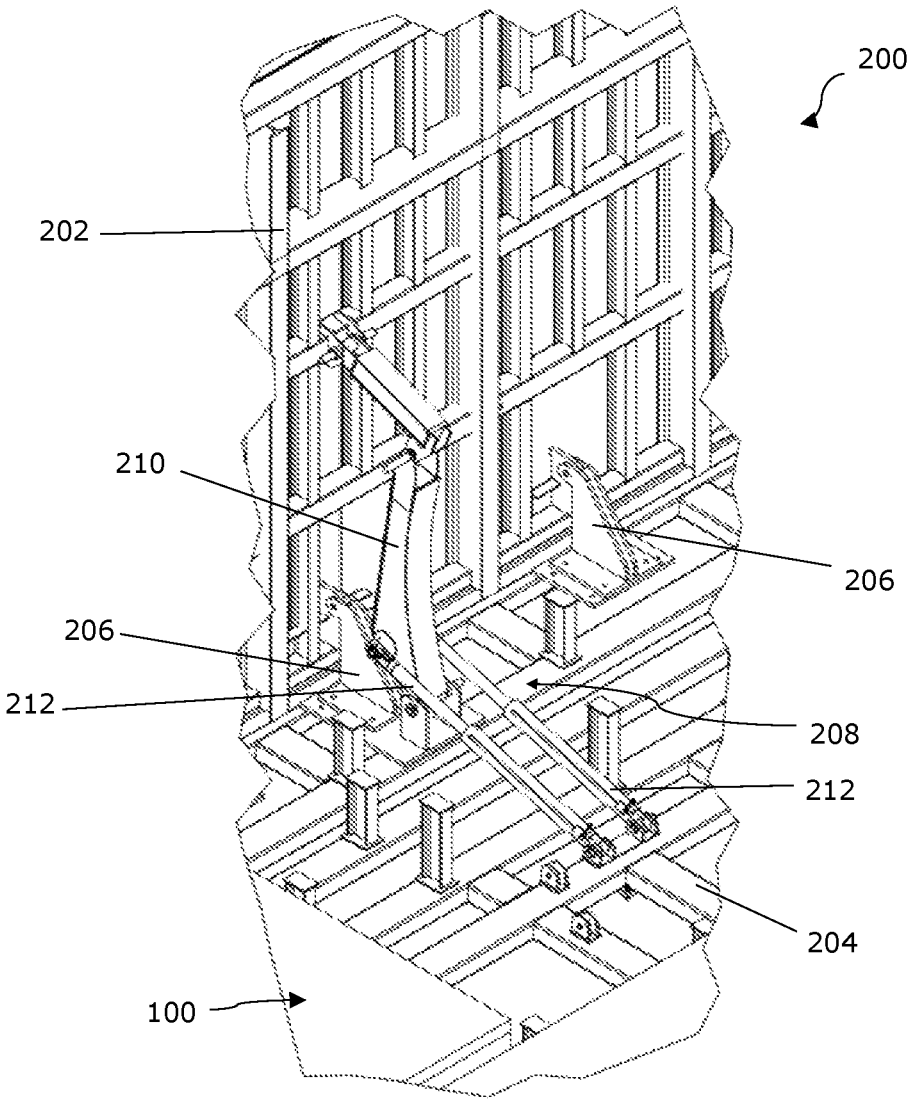
FIG. 3 is an enlarged view of an inner barrier module of the flood barrier system of FIG. 1A in a deployed configuration, showing a drive mechanism.

Referring still to FIGS. 2A and 2B and additionally FIG. 3, each barrier module 100, 200, 300 comprises a frame 104, 204, 304, housed in the housing pit 20, bearing a plurality of hinges 106, 206, 306 on which its barrier panel 102, 202, 302 is pivotably mounted. Each frame 104, 204, 304 also supports a drive mechanism 108, 208, 308 comprising articulated arms 110, 210, 310 and hydraulic cylinders 112, 212, 312, for driving movement of the associated barrier panel 102, 202, 302 between the stowed and deployed positions. For clarity, only some of the hinges 106, 206, 306, articulated arms 110, 210, 310 and hydraulic cylinders 112, 212, 312 are referenced in FIG. 2A. In this embodiment of the system 10 the drive mechanisms 108, 208, 308 are all identical and comprise two identical arms and cylinders. FIG. 3 is thus illustrative for all the modules 100, 200, 300.

The barrier modules 100, 200, 300, whilst sharing certain common features as discussed above, are of two different types. In particular, the outer barrier modules 100, 300 are of one type and the inner barrier module 200 is of another type. The two types of barrier module thus alternate. The two types of barrier module comprise differing sealing interfaces that are co-operable in the deployed position to seal together the barrier modules.

Figure 4A:
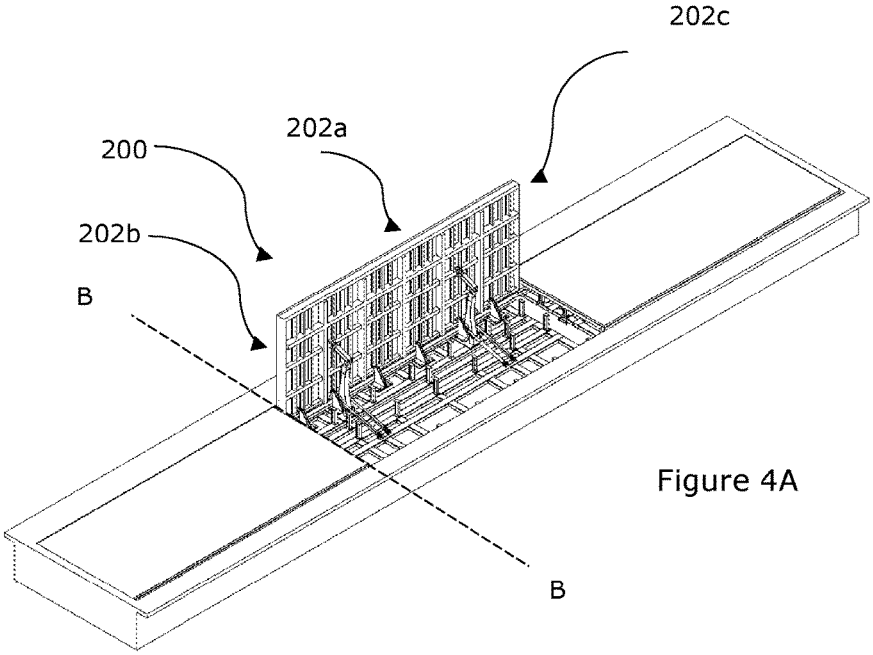
FIG. 4A is a perspective view of the flood barrier system of FIG. 1A with an inner barrier element in a deployed configuration and two other elements stowed.
Figure 4B:
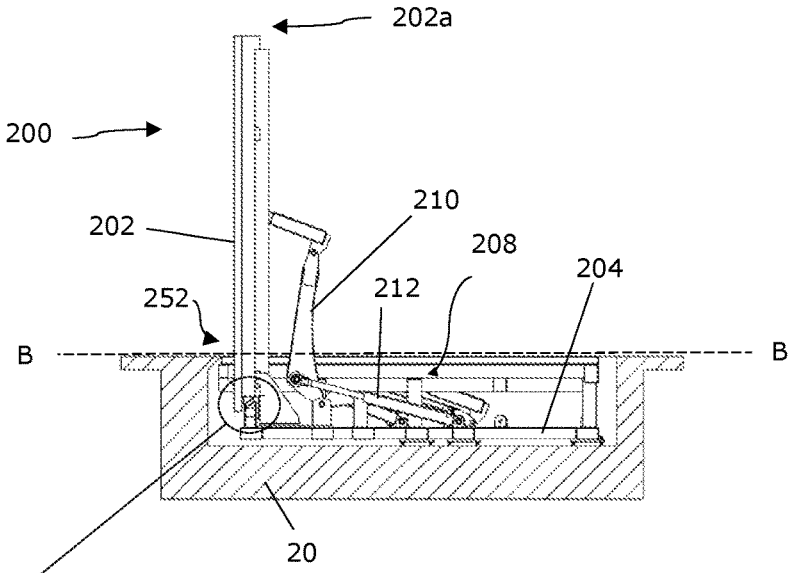
FIG. 4B is a cross-sectional view of the flood barrier system of FIG. 4A in taken at line B-B shown in FIG. 4A.
Figure 4C:
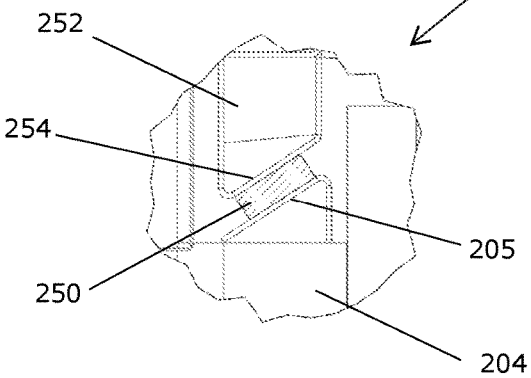
FIG. 4C is an enlarged view of a frame seal region of the inner barrier element of the flood barrier system of FIG. 4A in a deployed configuration.

Referring now to FIGS. 4A to 4C, the inner barrier module 200 comprises, in addition to the abovementioned common features, a compressible frame seal 250 for sealing a base portion 252 of its barrier panel 202 against its frame 204 in the deployed position. In particular, the frame seal 250 is compressed against the frame 204 when the barrier panel 202 of the inner barrier module 200 is brought into the deployed position (shown in FIGS. 4A to 4C).

With reference to FIG. 4C, to aid compression of the frame seal, the base 252 of the barrier panel 202 of the inner barrier module 200 comprises an engagement surface 254 for engaging the frame seal 250. The engagement surface 254 is angled such that the barrier panel 202 of the inner barrier module 200 exerts compressive force on the frame seal 250 substantially orthogonally to the engagement surface 254 when the barrier panel 202 is brought into the deployed position.

Similarly, the frame 204 comprises a seat surface 205 for engaging the frame seal 250, the seat surface 205 being angled such that the frame 204 exerts compressive force on the frame seal 250 substantially orthogonally to the seat surface 205 when the barrier panel 202 of the inner barrier module 200 is brought into the deployed position.

Because of the combined action of the engagement surface 254 and the seat surface 205, the frame seal 250 can provide a highly effective seal against floodwater at the base 252 of the barrier panel 202 of the inner barrier module 200. There is no requirement for the frame seal 250 to be inflatable: a simple compressive seal is enough.

The inner barrier module 200 is thus able to seal against the frame 204 in the deployed position, with a free edge 202*a* of its barrier panel 202 extending clear of the frame 204 to present a barrier segment between lateral edges 202*b*, 202*c* of the barrier panel 202. The lateral edges of the inner barrier module 200 do not comprise a seal but are instead designed to be sealed against by the barrier modules 100, 300 of the other type, as will now be described.

The outer barrier modules 100, 300 also comprise the common features discussed above. However, they have different sealing interfaces compared to the inner barrier module 200 and offset barrier panels 102, 302 as will now be described.

The structure of the outer barrier modules 100, 300 will be described with reference to the right-hand side outer barrier module 300. However, this description applies equally to the left-hand side outer barrier module 100 which is identical.

Figure 5A:
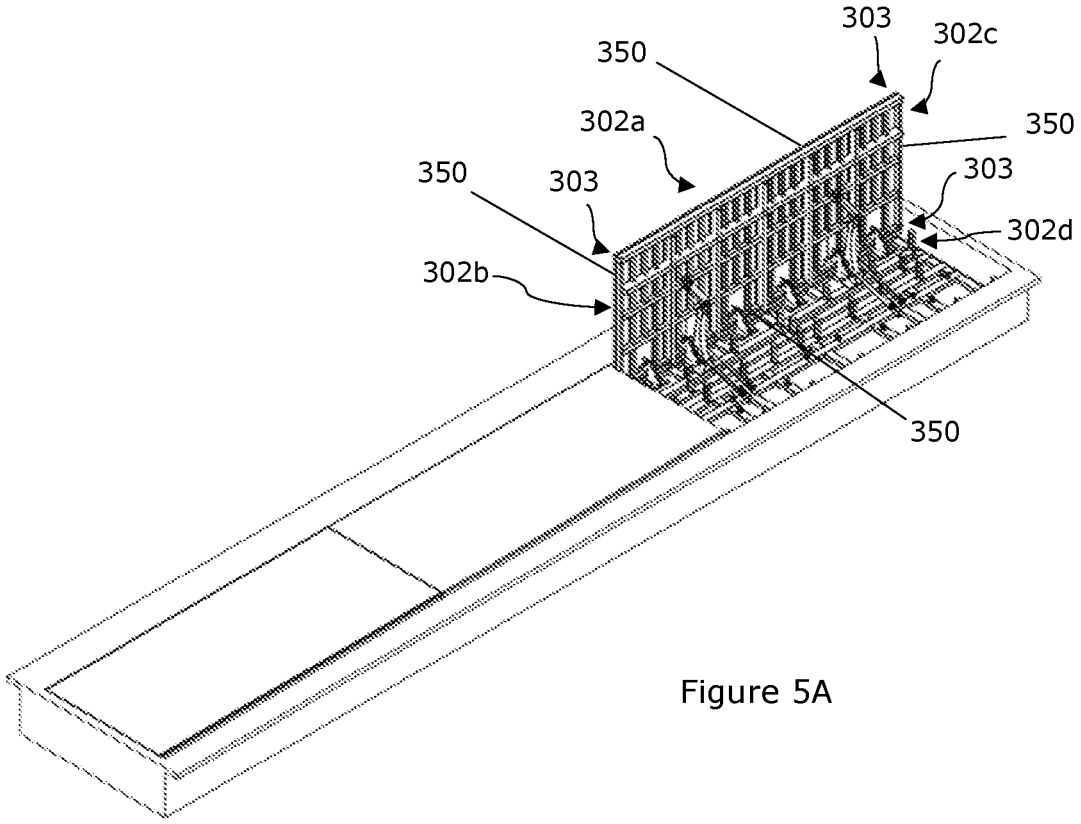
FIG. 5A is a perspective view of the flood barrier system of FIG. 1A with a right outer barrier element in a deployed position and two other elements stowed.

Referring now to FIG. 5A, the outer barrier module 300 comprises a U-shaped seal 350 running along lateral edges 302*b*, 302*c*, a base edge 302*d* and rounded corners 303 of its barrier panel 302. The U-shaped seal 350 is inflatable and comprises first and second parallel seal members 352, 354.

Figure 5B:
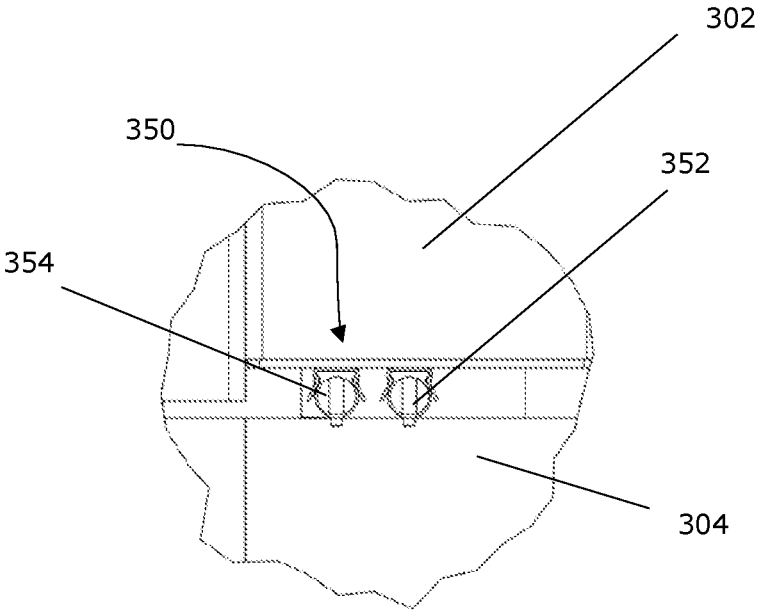
FIG. 5B is an enlarged view of a frame seal region of the outer barrier element deployed in FIG. 5A.

With reference to FIG. 5B, the U-shaped seal 350 acts as a frame seal at the base of the barrier panel 302 by sealing the barrier panel 302 against the frame 304. The outer barrier module 300 is thus also each able to seal against its frame 304 in the deployed position, with a free edge 302*a* of its barrier panel 302 extending clear of the frame 304 to present a barrier segment between lateral edges 302*b*, 302*c* of their barrier panel 302.

Figure 6A:
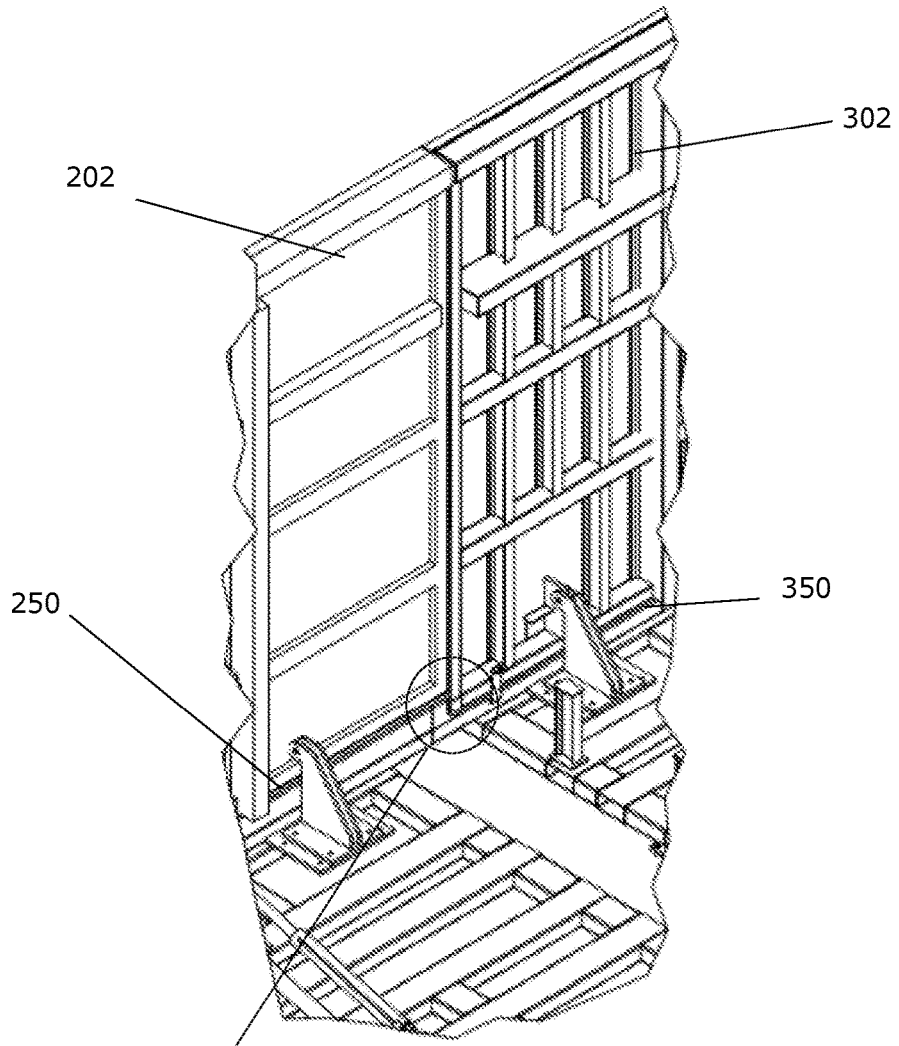
FIG. 6A is a partial perspective view showing an interface between a deployed inner barrier element and a deployed right outer barrier element of the flood barrier system of FIG. 1A.
Figure 6B:
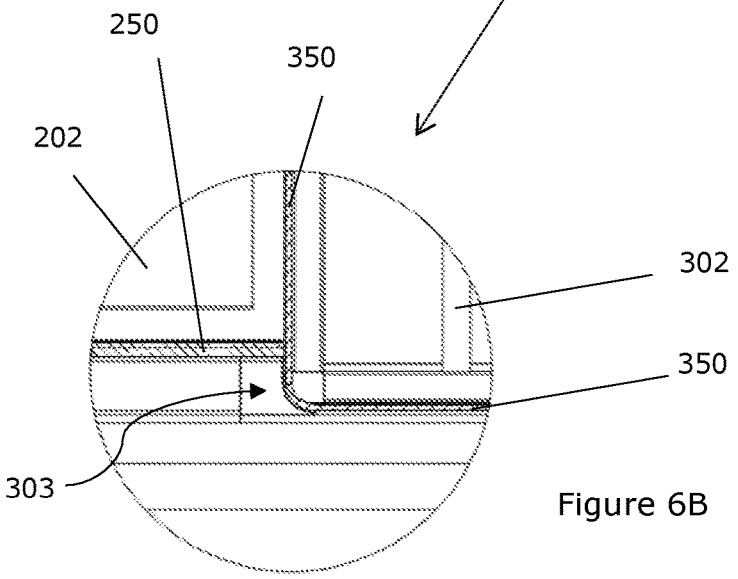
FIG. 6B is an enlarged perspective view showing a base region of the interface shown in FIG. 6A.

Referring now to FIGS. 6A and 6B, the U-shaped seal 350 also acts as a lateral seal on each side of the barrier panel 302. The outer barrier modules 100, 300 thus comprise a lateral seal for sealing against the inner barrier module 200 along respective lateral edges when the barrier panels 102, 202, 302 of the barrier modules 100, 200, 300 are in the deployed position.

Referring now specifically to FIG. 6B, a particularly difficult area to seal is the interface between the bases of the barrier panels 202, 302. To facilitate sealing in this area the barrier panels 102, 302 of the outer barrier modules are offset with respect to the barrier panel 202 of the inner barrier module such that in the deployed position the lateral seal of the outer barrier module 302 can seal against an end of the frame seal 250 of the inner barrier module 200.

In this manner a tight seal is formed between the adjacent barrier modules even at the base of the barrier panels 100, 200, 300. To further improve the seal, since the barrier panel of the outer barrier module 302 comprises rounded corners 303 between the lateral edges 302*b*, 302*c* of the barrier panel 300 and the base edge of the barrier panel 302*d*, the bases of the barrier panels of the outer barrier module 300 and inner barrier module 200 are offset such that the end of the frame seal 250 of the inner barrier module 200 seals against the lateral seal 350 of the outer barrier module 100, 200 beyond a corner radius of the rounded corners 303.

To bring the system into the active configuration, the barrier modules 100, 200, 300 are sealed together. First, the barrier panels 102, 202, 302 are first brought into the deployed position. This can happen in any desired order or indeed simultaneously although sequential movement of the barrier panels may be advantageous to reduce demand on hydraulics. The inner barrier module 200 is sealed against its frame 204 by the compressible seal 250. Thereafter, the inflatable seals 150, 350 of the outer barrier modules 100, 300 are inflated to seal the outer barrier modules 100, 300 against their frames 104, 304 and against the inner barrier module 200. The outer barrier modules 100, 300 may also seal against external structures, such as posts or walls (not shown) to form a barrier between the external structures.

To bring the system 10 back into its inactive configuration, the inflatable seals are deflated and the barrier modules 100, 200, 300 are moved back to their stowed positions.

Those skilled in the art will of course appreciate that many variations can readily be made in the described embodiment without departing from the scope of the invention as defined in the claims.

The invention claimed is:

1. A stowable flood barrier system comprising: first and second barrier modules each comprising a frame and a barrier panel pivotable with respect to the frame between a stowed position and a deployed position, in which deployed position a base of the barrier panel is sealed against the frame and a free edge of the barrier panel extends clear of the frame to present a barrier segment between lateral edges of the barrier panel, wherein the first and second barrier modules are sealable together in the deployed position along the lateral edges of their respective barrier panels to form a linked flood barrier, wherein the first and second barrier modules comprise differing sealing interfaces that are co-operable in the deployed position to seal together the first and second barrier modules, and wherein the first barrier module comprises an inflatable sealing interface and the second barrier module comprises a non-inflatable sealing interface.

2. The system of claim 1, wherein each of the first and second barrier modules comprises a frame seal for sealing the base of its barrier panel against its frame; and wherein the inflatable sealing interface of the first barrier module comprises a lateral seal for sealing together the first and second barrier modules along the lateral edges of the respective barrier panels to form the linked flood barrier.

3. The system of claim 2, wherein the bases of the barrier panels of the first and second barrier modules are offset with respect to each other in the deployed position such that the lateral seal of the first barrier module can seal against an end of the frame seal of the second barrier module.

4. The system of claim 3, wherein the base of the barrier panel of the first barrier module comprises rounded corners between the lateral edges of the barrier panel and a base edge of the barrier panel and wherein the bases of the barrier panels of the first and second barrier modules are offset with respect to each other in the deployed position such that the end of the frame seal of the second barrier module seals against the lateral seal of the first barrier module beyond a corner radius of the rounded corners.

5. The system of claim 2, wherein the frame seal of the first barrier module is inflatable to seal the first barrier module against the frame of the first barrier module.

6. The system of claim 5, wherein the frame seal of the first barrier module and the lateral seal of the first barrier module are integral.

7. The system of claim 6, wherein the base of the barrier panel of the first barrier module comprises rounded corners between the lateral edges of the barrier panel and a base edge of the barrier panel, and the frame seal and lateral seal of the first barrier module are constituted by an inflatable U-shaped seal running along the lateral edges, the base edge and the rounded corners of the panel.

8. The system of claim 2, wherein the frame seal of the second barrier module is compressed against the frame when the barrier panel of the second barrier module is brought into the deployed position.

9. The system of claim 8, wherein the base of the barrier panel of the second barrier module comprises an engagement surface for engaging the frame seal, the engagement surface being angled such that the barrier panel exerts compressive force on the frame seal substantially orthogonally to the engagement surface.

10. The system of claim 9, wherein the frame of the second barrier module comprises a seat surface for engaging the frame seal, the seat surface being angled such that the frame exerts compressive force on the frame seal substantially orthogonally to the seat surface.

11. The system of claim 2, wherein the frame seal of the second barrier module is non-inflatable.

12. The system of claim 1, wherein the frame of each barrier module comprises one or more mounts upon which the barrier panel is pivotably mounted.

13. The system of claim 12, wherein mounts of the first and second barrier modules define co-axial or parallel pivot axes.

14. The system of claim 1, comprising a plurality of the first barrier module and/or a plurality of the second barrier module, the first and second barrier modules alternating in extension of one another and being sealable together in the deployed position along the lateral edges of their respective barrier panels to form the linked flood barrier.

15. The system of claim 14, wherein outer ones of the first barrier modules flank one or more inner barrier modules, the outer barrier modules being sealable against an external structure.

16. The system of claim 1, wherein the first and second barrier modules are aligned such that the barrier segments offered by the first and second barrier modules in the deployed position have co-planar surfaces.

17. The system of claim 1, wherein the system comprises a housing pit for holding the first and second barrier modules.

18. The system of claim 1, installed in the ground such that the barrier panels are flush with the ground in the stowed position.

19. The system of claim 1, wherein the barrier panels of the first and second barrier module comprise a friction-increasing surface finish.

20. The system of claim 1, comprising a drive mechanism for moving the barrier panels of the first and second barrier modules between the stowed position and the deployed position.

21. The system of claim 20, wherein the drive mechanism allows for independent or sequential movement of the barrier panels of the first and second barrier modules between the stowed position and the deployed position.

22. The system of claim 1, comprising a flood condition sensor and a controller configured to deploy the flood barrier by bringing the barrier panels of the barrier modules into the deployed position in response to a detected flood condition.

23. The system of claim 22, comprising a proximity sensor to detect obstruction and wherein the controller is configured to omit or halt deployment of the flood barrier in response to a detected obstruction.

24. A method of erecting a flood barrier, the method comprising installing a flood barrier system according to claim 1 with the first and second barrier modules adjacent, bringing the barrier plates of the barrier modules into the deployed position and sealing the adjacent first and second barrier modules together.

* * * * *